US008656610B2

(12) United States Patent
Baucom et al.

(10) Patent No.: US 8,656,610 B2
(45) **Date of Patent: *Feb. 25, 2014**

(54) ARTICLES WITH RETRACTABLE TRACTION ELEMENTS

(75) Inventors: Jim Baucom, Portland, OR (US); Clifford B. Gerber, West Linn, OR (US)

(73) Assignee: Nike, Inc., Beaverton, OR (US)

( * ) Notice: Subject to any disclaimer, the term of this patent is extended or adjusted under 35 U.S.C. 154(b) by 81 days.

This patent is subject to a terminal disclaimer.

(21) Appl. No.: 13/295,582

(22) Filed: Nov. 14, 2011

(65) Prior Publication Data

US 2012/0055046 A1 Mar. 8, 2012

Related U.S. Application Data

(63) Continuation of application No. 12/239,190, filed on Sep. 26, 2008, now Pat. No. 8,079,160.

(51) Int. Cl.
*A43C 15/14* (2006.01)

(52) U.S. Cl.
USPC ..... 36/61

(58) Field of Classification Search
USPC ..... 36/61, 134, 67 A, 59 R
See application file for complete search history.

(56) References Cited

U.S. PATENT DOCUMENTS

| | | | |
|---|---|---|---|
| 303,287 | A | 8/1884 | Hunn |
| 830,324 | A | 9/1906 | Hunt |
| 1,361,078 | A | 12/1920 | Lynn |
| 1,736,576 | A | 11/1929 | Cable |
| 2,070,269 | A | 2/1937 | Goldenberg |
| 2,087,945 | A | 7/1937 | Butler |
| 2,095,095 | A | 10/1937 | Howard |
| 2,222,650 | A | 11/1940 | Brady |
| 2,258,734 | A | 10/1941 | Brady |
| 3,043,026 | A | 7/1962 | Semon |
| 3,063,171 | A | 11/1962 | Hollander |
| 3,352,034 | A | 11/1967 | Braun |
| 3,487,563 | A | 1/1970 | Austin |
| 3,619,916 | A | 11/1971 | Neri |
| 3,631,614 | A | 1/1972 | Rice |
| 3,775,874 | A | 12/1973 | Bonneville |
| 3,951,407 | A | 4/1976 | Calacurcio |

(Continued)

FOREIGN PATENT DOCUMENTS

| | | |
|---|---|---|
| CA | 2526727 | 5/2007 |
| CN | 101951799 A | 1/2011 |

(Continued)

OTHER PUBLICATIONS

Partial Search Report for PCT/US2009/058522 dated Mar. 4, 2010.

(Continued)

*Primary Examiner* — Ted Kavanaugh
(74) *Attorney, Agent, or Firm* — Banner & Witcoff, Ltd.

(57) ABSTRACT

Articles of manufacture and articles of wear may include one or more retractable traction elements. A plurality of the retractable traction elements may be interconnected by a base member and may form an insert. Each of the retractable traction elements may include an extension inducing element and a ground (or other surface) contacting element. The extension inducing element may flex in response to an applied force and may cause the ground or other surface contacting element to extend and engage an underlying surface.

23 Claims, 8 Drawing Sheets

(56) References Cited

U.S. PATENT DOCUMENTS

| | | | | |
|---|---|---|---|---|
| 4,146,979 | A | | 4/1979 | Fabbrie |
| 4,271,608 | A | | 6/1981 | Tomuro |
| 4,375,728 | A | | 3/1983 | Dassler |
| 4,375,729 | A | | 3/1983 | Buchanen, III |
| 4,466,205 | A | | 8/1984 | Corbari |
| 4,546,559 | A | | 10/1985 | Dassler |
| 4,562,651 | A | | 1/1986 | Frederick et al. |
| 4,633,600 | A | | 1/1987 | Dassler et al. |
| 4,674,200 | A | | 6/1987 | Sing |
| 4,715,133 | A | | 12/1987 | Hartjes et al. |
| 2,608,387 | A | | 6/1988 | Dufour |
| 4,821,434 | A | | 4/1989 | Chein |
| 4,825,562 | A | | 5/1989 | Chuang |
| 4,833,796 | A | | 5/1989 | Flemming |
| 4,873,774 | A | | 10/1989 | Lafever |
| 5,024,007 | A | | 6/1991 | DuFour |
| 5,221,379 | A | | 6/1993 | Nicholas |
| 5,289,647 | A | | 3/1994 | Mercer |
| 5,299,369 | A | | 4/1994 | Goldman |
| 5,351,422 | A | | 10/1994 | Fitzgerald |
| 5,367,791 | A | | 11/1994 | Gross et al. |
| 5,410,823 | A | | 5/1995 | Iyoob |
| 5,513,451 | A | | 5/1996 | Kataoka et al. |
| 5,524,364 | A | | 6/1996 | Cole et al. |
| 5,526,589 | A | | 6/1996 | Jordan |
| 5,634,283 | A | | 6/1997 | Kastner |
| 5,678,328 | A | | 10/1997 | Schmidt et al. |
| 5,775,010 | A | | 7/1998 | Kaneko |
| 5,786,057 | A | | 7/1998 | Lyden et al. |
| 5,806,209 | A | | 9/1998 | Crowley et al. |
| 5,815,951 | A | | 10/1998 | Jordan |
| 5,843,268 | A | | 12/1998 | Lyden et al. |
| 5,906,872 | A | | 5/1999 | Lyden et al. |
| 5,915,820 | A | | 6/1999 | Kraeuter et al. |
| 5,946,828 | A | | 9/1999 | Jordan et al. |
| 5,956,871 | A | | 9/1999 | Korsen |
| 5,979,083 | A | | 11/1999 | Robinson et al. |
| 5,983,529 | A | | 11/1999 | Serna |
| 6,029,377 | A | | 2/2000 | Niikura et al. |
| 6,035,559 | A | | 3/2000 | Freed et al. |
| 6,058,627 | A | * | 5/2000 | Violette et al. ..... 36/61 |
| 6,079,127 | A | | 6/2000 | Nishimura et al. |
| 6,112,433 | A | | 9/2000 | Greiner |
| 6,119,373 | A | | 9/2000 | Gebhard et al. |
| 6,125,556 | A | | 10/2000 | Peckler et al. |
| 6,256,907 | B1 | | 7/2001 | Jordan et al. |
| 6,357,146 | B1 | | 3/2002 | Wordsworth et al. |
| 6,389,714 | B1 | | 5/2002 | Mack |
| 6,438,873 | B1 | | 8/2002 | Gebhard et al. |
| 6,477,791 | B2 | | 11/2002 | Luthi et al. |
| 6,481,122 | B2 | | 11/2002 | Brahler |
| 6,550,160 | B2 | | 4/2003 | Miller, II |
| 6,647,647 | B2 | | 11/2003 | Auger et al. |
| 6,658,766 | B2 | | 12/2003 | Kraeuter et al. |
| 6,675,505 | B2 | | 1/2004 | Terashima |
| 6,698,110 | B1 | | 3/2004 | Robbins |
| 6,739,075 | B2 | | 5/2004 | Sizemore |
| D495,122 | S | | 8/2004 | McMullin |
| 6,834,446 | B2 | | 12/2004 | McMullin |
| 6,857,205 | B1 | | 2/2005 | Fusco et al. |
| 6,904,707 | B2 | | 6/2005 | McMullin |
| 6,915,595 | B2 | | 7/2005 | Kastner |
| 6,915,596 | B2 | | 7/2005 | Grove et al. |
| 6,920,705 | B2 | | 7/2005 | Lucas et al. |
| 6,941,684 | B2 | | 9/2005 | Auger et al. |
| 6,948,264 | B1 | | 9/2005 | Lyden |
| 7,007,410 | B2 | | 3/2006 | Auger et al. |
| 7,124,519 | B2 | | 10/2006 | Issler |
| 7,143,530 | B2 | | 12/2006 | Hudson et al. |
| 7,194,826 | B2 | | 3/2007 | Ungari |
| 7,234,250 | B2 | | 6/2007 | Fogarty et al. |
| 7,243,445 | B2 | | 7/2007 | Manz et al. |
| 7,254,909 | B2 | | 8/2007 | Ungari |
| 7,269,916 | B2 | | 9/2007 | Biancucci et al. |
| 7,287,343 | B2 | | 10/2007 | Healy |
| 7,370,439 | B1 | | 5/2008 | Myers |
| 7,386,948 | B2 | | 6/2008 | Sink |
| 7,406,781 | B2 | | 8/2008 | Scholz |
| 7,409,783 | B2 | | 8/2008 | Chang |
| 7,430,819 | B2 | | 10/2008 | Auger et al. |
| 7,490,418 | B2 | | 2/2009 | Obeydani |
| 7,523,566 | B2 | | 4/2009 | Young-Chul |
| 7,559,160 | B2 | | 7/2009 | Kelly |
| 7,584,554 | B2 | | 9/2009 | Fogarty et al. |
| 7,654,013 | B2 | | 2/2010 | Savoie et al. |
| 7,784,196 | B1 | | 8/2010 | Christensen et al. |
| 7,818,897 | B2 | | 10/2010 | Geer |
| 7,954,257 | B2 | | 6/2011 | Banik |
| 8,079,160 | B2 | | 12/2011 | Baucom et al. |
| 8,122,617 | B1 | | 2/2012 | Dixon et al. |
| 8,256,145 | B2 | | 9/2012 | Baucom |
| 8,356,428 | B2 | | 1/2013 | Auger et al. |
| 8,453,349 | B2 | | 6/2013 | Auger et al. |
| 2001/0005947 | A1 | | 7/2001 | Sordi |
| 2002/0017036 | A1 | | 2/2002 | Berger et al. |
| 2002/0062578 | A1 | | 5/2002 | Lussier et al. |
| 2002/0078603 | A1 | | 6/2002 | Schmitt, Jr. |
| 2002/0100190 | A1 | | 8/2002 | Pellerin |
| 2003/0033731 | A1 | | 2/2003 | Sizemore |
| 2003/0188458 | A1 | | 10/2003 | Kelly |
| 2004/0035024 | A1 | | 2/2004 | Kao |
| 2004/0163282 | A1 | | 8/2004 | Pan |
| 2004/0187356 | A1 | | 9/2004 | Patton |
| 2004/0250451 | A1 | | 12/2004 | McMullin |
| 2005/0072026 | A1 | | 4/2005 | Sink |
| 2005/0217149 | A1 | | 10/2005 | Ho |
| 2005/0257405 | A1 | | 11/2005 | Kilgore |
| 2005/0268490 | A1 | | 12/2005 | Foxen |
| 2006/0016101 | A1 | | 1/2006 | Ungari |
| 2006/0021254 | A1 | | 2/2006 | Jones |
| 2006/0130372 | A1 | | 6/2006 | Auger et al. |
| 2006/0242863 | A1 | | 11/2006 | Patmore |
| 2007/0261271 | A1 | | 11/2007 | Krouse |
| 2008/0066348 | A1 | | 3/2008 | O'Brien et al. |
| 2008/0072457 | A1 | | 3/2008 | Shakoor et al. |
| 2008/0196276 | A1 | | 8/2008 | McMullin |
| 2008/0216352 | A1 | | 9/2008 | Baucom et al. |
| 2008/0271341 | A1 | | 11/2008 | Amark |
| 2009/0056172 | A1 | | 3/2009 | Cho |
| 2009/0100716 | A1 | | 4/2009 | Gerber |
| 2009/0100718 | A1 | | 4/2009 | Gerber |
| 2009/0126230 | A1 | | 5/2009 | McDonald et al. |
| 2009/0223088 | A1 | | 9/2009 | Krikorian et al. |
| 2009/0241370 | A1 | | 10/2009 | Kimura |
| 2009/0249648 | A1 | | 10/2009 | Brown et al. |
| 2009/0307933 | A1 | | 12/2009 | Leach |
| 2009/0313856 | A1 | | 12/2009 | Arizumi |
| 2010/0005684 | A1 | | 1/2010 | Nishiwaki et al. |
| 2010/0024250 | A1 | | 2/2010 | Fogarty et al. |
| 2010/0050475 | A1 | | 3/2010 | Benz et al. |
| 2010/0077635 | A1 | | 4/2010 | Baucom et al. |
| 2010/0083539 | A1 | | 4/2010 | Norton |
| 2010/0083541 | A1 | | 4/2010 | Baucom et al. |
| 2010/0212190 | A1 | | 8/2010 | Schmid |
| 2010/0251578 | A1 | | 10/2010 | Auger et al. |
| 2010/0313447 | A1 | | 12/2010 | Becker et al. |
| 2011/0047830 | A1 | | 3/2011 | Francello et al. |
| 2011/0078927 | A1 | | 4/2011 | Baker |
| 2011/0126426 | A1 | | 6/2011 | Amark |
| 2011/0146110 | A1 | | 6/2011 | Geer |
| 2011/0192056 | A1 | | 8/2011 | Geser et al. |
| 2011/0197478 | A1 | | 8/2011 | Baker |
| 2011/0203136 | A1 | | 8/2011 | Auger |
| 2012/0036740 | A1 | | 2/2012 | Gerber |

FOREIGN PATENT DOCUMENTS

| | | |
|---|---|---|
| DE | 930798 | 7/1955 |
| DE | 2927635 | 1/1981 |
| DE | 3046811 | 7/1982 |
| DE | 3245182 | 5/1983 |
| DE | 3600525 | 10/1987 |
| DE | 3644812 | 6/1988 |
| DE | 3703932 | 8/1988 |

(56) References Cited

FOREIGN PATENT DOCUMENTS

| | | |
|---|---|---|
| DE | 102008033241 | 11/2009 |
| EP | 0223700 | 5/1987 |
| EP | 723745 | 7/1996 |
| EP | 0890321 | 1/1999 |
| EP | 965281 | 12/1999 |
| EP | 1106093 | 6/2001 |
| EP | 1234516 | 8/2002 |
| EP | 1369049 | 12/2003 |
| EP | 1714571 | 10/2006 |
| EP | 1839511 | 10/2007 |
| EP | 2014186 | 1/2009 |
| EP | 2057913 | 5/2009 |
| EP | 2286684 | 2/2011 |
| EP | 2305056 | 4/2011 |
| EP | 2319342 | 5/2011 |
| FR | 2567004 | 1/1986 |
| FR | 2775875 | 9/1999 |
| FR | 2818876 | 7/2002 |
| GB | 2340378 | 2/2000 |
| JP | 8214910 | 8/1996 |
| JP | 10000105 | 6/1998 |
| JP | 2000236906 | 9/2000 |
| JP | 2002142802 | 5/2002 |
| JP | 2003284605 | 10/2003 |
| JP | 2006198101 | 8/2006 |
| TW | 540323 U | 7/2003 |
| TW | M267886 U | 6/2005 |
| WO | 9807341 | 2/1998 |
| WO | 9820763 | 5/1998 |
| WO | 0053047 | 9/2000 |
| WO | 03071893 | 9/2003 |
| WO | 2006103619 | 10/2006 |
| WO | 2007138947 | 12/2007 |
| WO | 2008069751 | 6/2008 |
| WO | 2008128712 | 10/2008 |
| WO | 2009110822 | 9/2009 |
| WO | 2010036988 | 4/2010 |
| WO | 2010057207 | 5/2010 |
| WO | 2012150971 | 11/2012 |

OTHER PUBLICATIONS

International Search Report and Written Opinion of PCT/US2010/029640 dated May 17, 2010.

International Search Report and Written Opinion of PCT/US2009/058522 dated Feb. 17, 2010.

International Search Report and Written Opinion for PCT/US2010/050637 dated Jan. 14, 2011.

International Search Report and Written Opinion for PCT/US2011/022841 dated Apr. 15, 2011.

International Search Report and Written Opinion for PCT/US2011/022848 dated Jun. 20, 2011.

Aug. 12, 2010, Icebug web page (date based on information from Internet Archive).

Dec. 23, 2008, Icebug web page (date based on information from Internet Archive).

International Search Report and Written Opinion for PCT/US2011/045356 dated Dec. 16, 2011.

First Office Action in CN200980137560.9 dated Feb. 8, 2013.

International Preliminary Report on Patentability (including Written Opinion of the ISA mailed May 3, 2012 in International Application No. PCT/US2010/053340.

Wiki(Boot)Leaks: adiZero II & adipure11Pro-More Info!, dated Jun. 22, 2011, accessed Aug. 25, 2011. http://www.soccerreviews.com.

Invitation to Pay Additional Fees mailed May 4, 2011 in International Application No. PCT/US2010/053340.

International Search Report and Written Opinion mailed Aug. 12, 2011 in International Application No. PCT/US2010/053340.

* cited by examiner

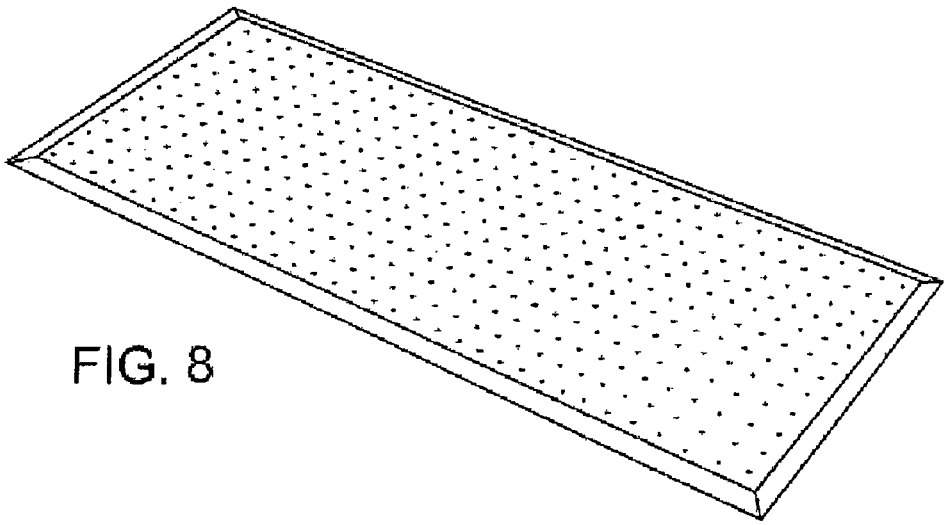
FIG. 8
FIG. 9
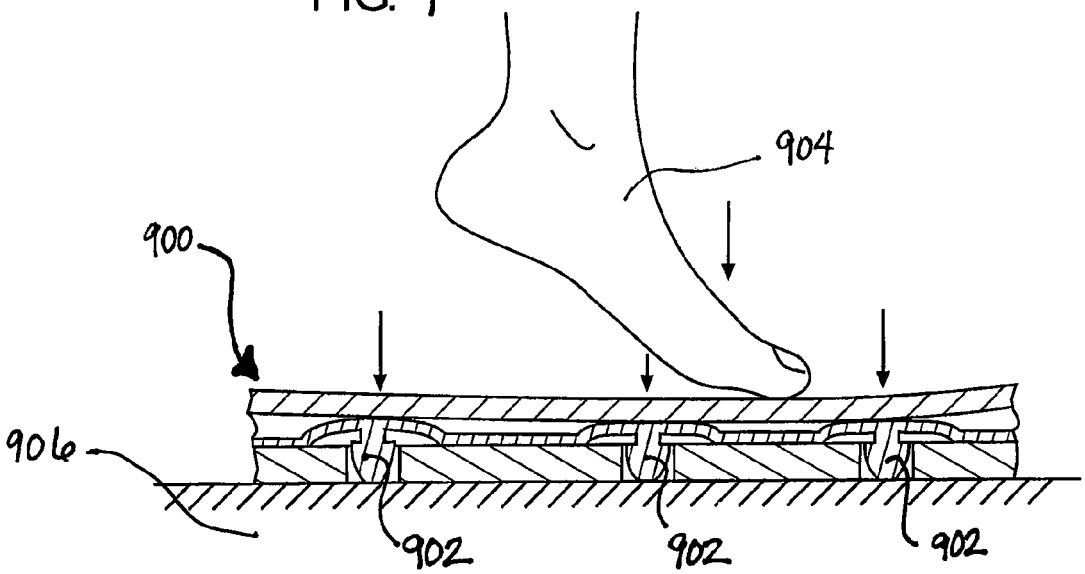

ARTICLES WITH RETRACTABLE TRACTION ELEMENTS

CROSS-REFERENCE TO RELATED APPLICATIONS

This application is a continuation of U.S. Non-Provisional Application Ser. No. 12/239,190, filed Sep. 26, 2008, and titled "Articles with Retractable Traction Elements"(now U.S. Pat. No. 8,079,160), the entire contents of which are incorporated by reference herein.

FIELD OF THE INVENTION

Aspects of the invention relate generally to fraction elements for articles of manufacture and articles of wear such as footwear, apparel, athletic or protective gear. More specifically, aspects of the invention relate to traction elements for articles of manufacture that are selectively retractable.

BACKGROUND

Many articles of wear benefit from traction elements. Such articles of wear usually come into contact with a surface or another item and benefit from the increased friction and stability provided by the traction elements. Many people wear footwear, apparel, athletic and protective gear and expect these articles of wear to provide traction and stability during use. For example, articles of footwear may include traction elements that are attached to the ground contacting surface of a sole structure. The traction elements may provide gripping characteristics that help create supportive and secure contact between the wearer's foot and the ground.

Most traction elements are attached to the ground contacting surface of an article of wear. Such traction elements are often rigid and provide a single type and quantity of traction. These traction elements do not respond to the evolving needs of the user nor do they respond to the inherent physiological differences between users. These traction elements may tend to wear unevenly and frequently need to be repaired and/or replaced, which can be expensive and time-consuming.

Some traction elements may be detachable and an article of wear may be capable of receiving several different types, sizes, and characteristics of traction elements (e.g., track spikes may be detachable from the article of footwear and replaceable with longer spikes, e.g., for use on different surfaces and/or different weather conditions). However, removing a first type of traction element and attaching a second type of traction element is time-consuming and inconvenient. Many wearers cannot afford the time that it takes to replace traction elements during use and/or the costs associated with replacing the traction elements. Additionally, many wearers need traction elements that can respond to the motion of the article of wear during use.

For example, the traction elements attached to an article of footwear may not be able to respond to the typical motion that a wearer's foot may undergo during use. An athlete may wish to stop abruptly, turn, pivot, rock onto the medial or lateral edges of the foot and thus the athlete would benefit from traction elements that dynamically respond to the motion. Further, the athlete may also wish to have traction reduced during normal activity, such as running, walking, or standing, e.g., in order to avoid excessive wear of the traction elements and/or damage to a surface. Most of the traction elements currently available are unable to provide the varying amounts of traction during various activities without requiring manual detachment and reattachment of the traction elements.

Therefore, while some traction elements are currently available, there is room for improvement in this art. For example, an article of wear having traction elements that may be selectively retractable, depending on the force applied to the article of wear, while remaining comfortable and flexible for the user would be a desirable advancement in the art. Additionally, traction elements that protect against wear and that selectively retract and extend in response to a force would also be welcomed in the art.

SUMMARY

The following presents a general summary of aspects of the invention in order to provide a basic understanding of at least some of its aspects. This summary is not an extensive overview of the invention. It is not intended to identify key or critical elements of the invention and/or to delineate the scope of the invention. The following summary merely presents some concepts of the invention in a general form as a prelude to the more detailed description provided below.

Aspects of this invention relate to articles of wear, such as footwear, athletic or protective equipment, and apparel, having traction elements. In an aspect, retractable traction elements may be included in articles of footwear. The article of footwear may comprise an upper, a sole member, and a plurality of traction elements. The sole member may be attached to the upper and the sole member may have a plurality of openings. The plurality of traction elements may be provided within or attached at least to the sole member and may be capable of selectively extending from a first position to a second position. A first portion of the plurality of traction elements may include a ground-contacting element and an extension inducing element. The extension inducing element may be capable of operationally engaging the ground-contacting element so that it may move from the first position to the second position and extend through one of the openings in the sole member and engage with a surface.

Additional aspects of this invention relate to traction elements for articles of manufacture and articles of wear. The fraction elements may comprise a first extension inducing element and a first ground-contacting element attached to the first extension inducing element. The traction element may also comprise a second extension inducing element and a second ground-contacting element that may be attached to the second extension element. The traction element may also include a base member that may interconnect the first extension inducing element and the second extension inducing element. The first extension inducing element and the second extension inducing element may be capable of inducing their respective ground-contacting element to extend from a first position to a second position in response to an application of force on the first extension inducing element and the second extension inducing element.

Still additional aspects of the invention relate to methods of providing traction for articles of manufacture. The method may comprise applying a force to a traction element, the traction element having an extension inducing element and a ground-contacting element. The extension inducing element may be attached to and operationally engaged with the ground-contacting element. The ground-contacting element may be caused to selectively extend through an opening in a base element of an article of manufacture in response to the application of force to the traction element. The ground-contacting element may be selectively extended from a first retracted position to a second extended position. The ground-contacting element may be caused to engage with a surface when the traction element is in the second position.

BRIEF DESCRIPTION OF THE DRAWINGS

A more complete understanding of the present invention and certain advantages thereof may be acquired by referring to the following description along with the accompanying drawings, in which like reference numbers indicate like features, and wherein:

FIG. 8 illustrates a mat containing a plurality of traction elements, according to aspects of the invention.

FIG. 9 illustrates a user's foot engaging a mat having a plurality of traction elements according to an aspect of the invention.

Figures 1A, 1B:
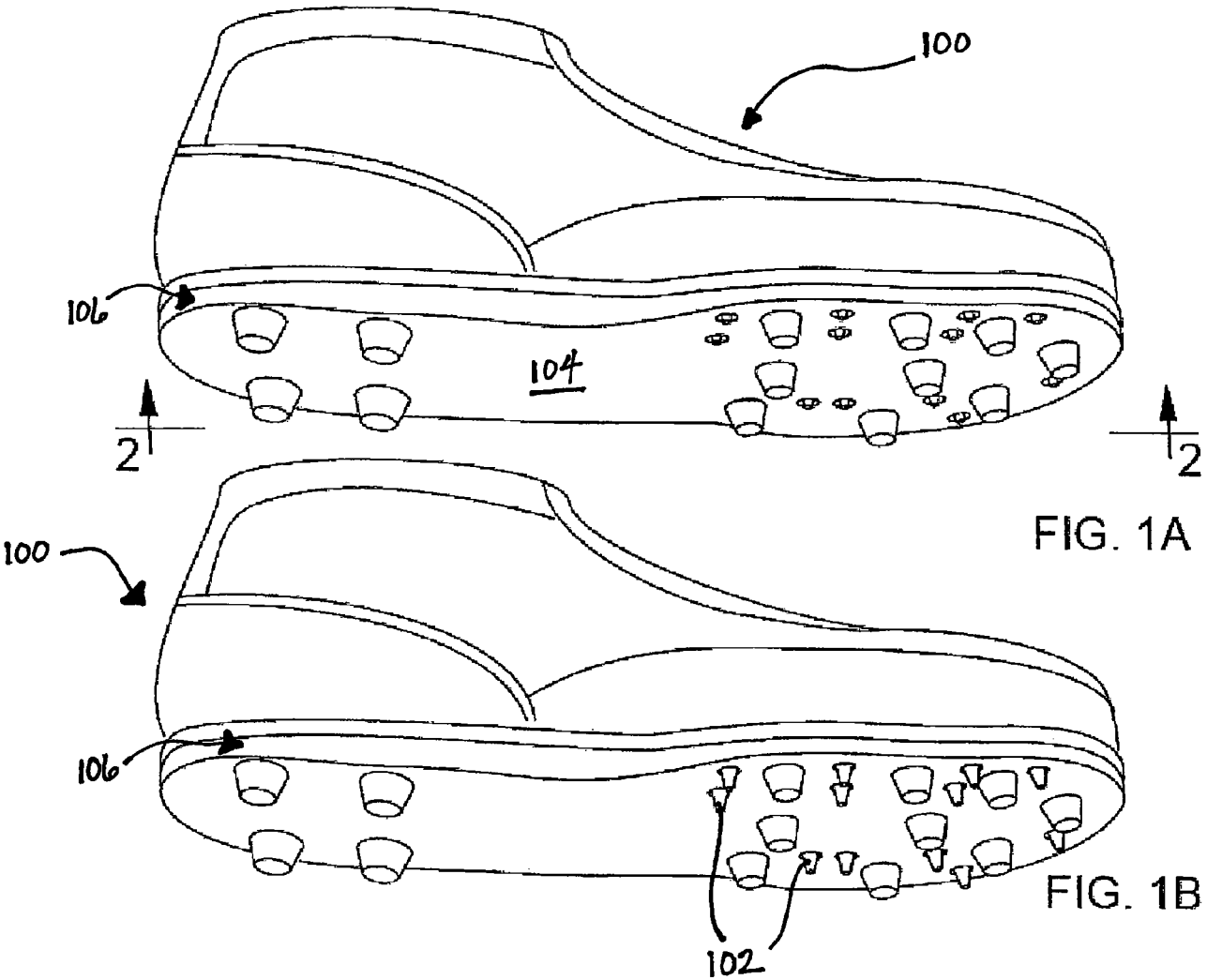
FIGS. 1A and 1B illustrate a plurality of retractable traction elements embodied in an article of footwear, in accordance with an aspect of the invention.

The reader is advised that the attached drawings are not necessarily drawn to scale.

DETAILED DESCRIPTION

In the following description of various example embodiments of the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

A. General Description of Articles with Retractable Traction Elements According to Examples of the Invention In general, as described above, aspects of the invention relate to retractable traction elements. In accordance with at least some aspects of the invention, retractable traction elements may be embodied in an article of footwear that includes: (a) an upper; (b) a sole member engaged with the upper, the sole member having a plurality of openings; and (c) a plurality of retractable traction elements capable of selectively extending from a first position to a second position, wherein at least some of the plurality of retractable traction elements include a ground-contacting element and an extension inducing element, the extension inducing element capable of operationally engaging the ground-contacting element to extend through one of the openings when at least one of the traction elements is positioned in the second position.

The retractable traction elements may be included in any article of manufacture or article of wear. An article of manufacture may be any item or product that may be made by hand or by machine and may include items such as protective gear and athletic equipment. An article of wear may include any item that may be worn, such as articles of apparel and articles of footwear.

As a more specific example, an article of wear in accordance with at least some examples of this invention may include an article of footwear. The article of footwear may include an upper and a sole member. For reference purposes only, the article of footwear may be divided into three general regions: a forefoot region, a midfoot region, and a heel region. The article of footwear may also include a lateral side and a medial side. The lateral side may reference the side of the article of footwear that is farthest away from the center axis of the user's body. The medial side may reference the side of the article of footwear that is nearest the center axis of the user's body. The lateral side and the medial side may reference opposing sides of the article of footwear.

The forefoot region may correspond with the portion of the article of footwear that may be capable of receiving and/or housing the metatarsals and phalanges (the toes and corresponding joint bones). The midfoot region may correspond with the arch area of the foot, and the heel region may correspond with the rear portion of the foot, including the calcaneus bone. The forefoot region, the midfoot region, and the heel region are intended to represent general areas of the article of footwear to aid in the following discussion and are not intended to demarcate precise areas of the article of footwear. The forefoot region, the midfoot region, and the heel region may also correspond to the sole member, the upper, and the individual elements thereof.

The sole member may be attached to the upper and may be positioned between the upper and the ground when the article of footwear is worn. The sole member may help provide traction and may attenuate impact forces when the sole member engages with the ground during wear such as walking, running, or other activities that cause the sole member to engage with a surface.

One example structure for an article of footwear may be an upper and a sole member having an outsole, a midsole, and an insole. The midsole may be secured to the lower portion of the upper and may be primarily formed from a polymer foam element (e.g., a polyurethane or ethylvinylacetate foam, phylon, phylite, etc.). The outsole may be secured to the lower/outer surface of the midsole and may be formed from textured rubber or other materials that impart a relatively high degree of wear resistance and/or traction properties.

The insole may be positioned within the upper and may extend along at least a portion of the longitudinal length of the sole member (i.e., along the length of the midsole and/or the outsole). The insole may extend along a portion or all of the interior surface of the midsole (i.e., the midsole surface that faces the interior of the upper). The insole may be positioned to extend beneath the forefoot region, the midfoot region, and/or the heel region of the wearer's foot. Although this configuration may be a suitable example sole member and upper combination, a variety of other combinations and configurations of the upper and the sole member may be utilized without departing from the present invention. For example, an article of footwear may not include either or both of an insole or an outsole or may include interchangeable insoles and outsoles.

The upper of the article of footwear may define a void for receiving a user's foot and for securing the article of footwear to the user's foot. The void may be shaped to accommodate a foot and may extend along the lateral side of the foot, along the medial side of the foot, over the instep of the foot, and/or under the foot. The article of footwear may be any suitable design including, but not limited to an athletic shoe, a hiking boot, a water shoe, a sandal, or the like.

Access to the void generally is provided by an ankle opening that may be located at or near the heel region of the article of footwear. A securing element may help secure the article of footwear to the wearer's foot and may accommodate feet of varying sizes and shapes. The securing element may permit the wearer to loosen the attachment of the article of footwear to the wearer's foot to facilitate removal. The securing element may be any suitable form, including a lace configuration, a hook and loop configuration, elastic, straps, zippers, buttons, buckles, mechanical connectors, or any other suitable securing mechanism.

As discussed above, the sole member may be attached to the upper and may have a plurality of openings. Traction elements may be attached to or included within the sole member and may be capable of selectively extending from a first (retracted) position to a second (extended) position through the openings. The openings may be shaped to receive the traction elements and optionally to slidingly engage the traction elements as they move from a first position to a second position. The openings may be any suitable shape and may oftentimes be a complimentary shape to the shape of the traction elements (i.e., the fraction elements are conically or cylindrically shaped and the openings are round or cylindrically shaped).

The edges of the openings may be straight, rounded, beveled, or any other suitable shape that permits the traction elements to easily move through and/or slide along the opening. In one example, the edges of the openings may slidingly engage a portion of the traction element when it moves from the first position to the second position. The edge of the openings may be slightly rounded to facilitate easy sliding of the retractable traction element against the interior surface and edge of the opening. If desired, a cover element (such as a slitted plastic sheet) may cover the openings, to help prevent dirt, mud, or other debris from entering the openings.

The fraction elements may be attached to the sole member in any suitable fashion. For example, the traction elements may be fixedly attached to the sole member by adhesive, molding, or the like. The traction elements and the sole member may be of a unitary construction. The traction elements may be detachable from the sole member via any suitable configuration such as mechanical connectors and thread and screw arrangements.

The traction elements may be attached to at least the sole member. In some examples, the sole member comprises an outsole, a midsole, and an insole. The traction elements may be attached to any portion of the article of footwear. For example, the traction elements may be attached to and/or located between the outsole and/or the midsole. In other examples, the traction elements may be attached to and/or located between the sole member and the upper.

In one example, a first portion of the traction elements may be attached to or included as part of the midsole of the sole member and may extend through corresponding openings provided in the outsole (e.g., a plate member) to engage the ground during use. The first portion of the traction elements may be retractable or may be non-retractable.

For example, a plurality of primary, non-retractable traction elements may be attached to the outsole of the sole member and may be optionally removable. Secondary, retractable traction elements may be positioned to extend along a medial portion and a lateral portion of the forefoot region of the article of footwear. The primary, non-retractable traction elements may be positioned along the forefoot region, the midfoot region, and the heel region of the outsole.

The primary traction elements may be retractable or non-retractable. The secondary traction elements may be retractable or non-retractable. The term "primary" may relate to a portion of the traction elements that may experience the most force during the athlete's motions. The term "secondary" may relate to a portion of the traction elements that engages when the athlete performs a particular motion. In some examples, both the primary traction elements or a portion thereof and the secondary traction elements or a portion thereof may be retractable. In such an example embodiment, the primary traction elements may have different properties than the second traction elements.

The retractable and the non-retractable traction elements may be positioned in any desired configuration. For example, a medial group of the primary traction elements may be grouped together and may extend longitudinally along the length of the forefoot region of the outsole, at or near the medial edge. A lateral group of primary traction elements may be grouped together and may extend along the length of the forefoot region of the outsole, at or near the lateral edge.

The motion of a wearer's foot during normal use may cause the application of force to the medial and/or the lateral edges of the sole member as it engages with a surface; the pivot action of a foot when a user changes direction; or any other action that causes the wearer's foot to supinate and/or pronate. For example, a normal walking cycle comprises a pronation phase, a supination phase, and a swing phase. During the pronation phase, the heel region of the wearer's foot strikes the ground or surface, and the leg is extended in a direction usually toward the direction in which the wearer is walking. The strike of the heel region against the ground includes a forward, horizontal force that slows the body's forward motion and a downward, vertical force that absorbs and controls the body's downward motion and stabilizes the body's balance as it engages with the ground or surface.

Generally, the body's center of gravity moves forward after the pronation or striking phase and shifts into a supination or propulsion phase. The supination phase includes little or no vertical force and a horizontal force that is directed in the direction opposite of the wearer's movement (i.e., if the wearer wishes to travel forward, the horizontal force is directed behind the wearer). During this transition, the force extends from the heel region of the wearer's foot through the lateral portion of the midfoot region and into both the lateral and medial areas of the forefoot region. Force may be exerted from the forefoot region against the ground or surface to lift the wearer's foot (and ultimately the wearer's entire leg) off of the ground and into a swing phase when it rotates around an axis defined by the hip joint and swings through to intersect a coronal plane (generally parallel to a sagittal plane) to begin a new walking cycle. Similar phases are experienced when the wearer runs, jogs, or the like.

During the supination, pronation, and swing phases described above, the same or similar points along the sole member may repeatedly engage with the ground or surface. The various portions of the retractable traction elements may be positioned within the heel region and the forefoot region of the sole member to provide the wearer with maximum stability and traction as the sole member engages with the ground or surface.

Primary traction elements may be positioned within any region or point of contact between the sole member and the ground or surface that are described above. However, they may provide the greatest traction characteristics when strategically placed in the regions and the positions that are most likely to endure most of the force during the supination, pronation, and swing phases (i.e., the contact points along the sole member that engage the ground or surface during the supination and pronation phases, as discussed above).

Primary traction elements may be attached to the outsole in any desired configuration, as discussed above. For example, the primary traction elements may be positioned in the forefoot region and within the heel region of the outsole. A first group of primary traction elements may be positioned near, adjacent to, or mingled among secondary traction elements, which will be discussed in greater detail below.

The positioning of each of the retractable fraction elements and the non-retractable traction elements may be in any suitable configuration. Many of the retractable traction elements may be positioned at areas of the sole member that experience a high quantity of force and/or may benefit from additional traction during specific motions. Some common activities may include the user pivoting, spinning, changing direction of motion, running, jumping, walking, or the like. In many examples, the retractable fraction elements may not be located within the midfoot region of the article of footwear, but rather may be concentrated within the forefoot region and the heel region of the article of footwear. These regions may receive most of the impact when an article of footwear may be in use, particularly in some of the direction change or other activities described above.

In another example, the retractable traction elements may be positioned along a medial portion and a lateral portion of the forefoot region of the sole member. A plurality of the retractable traction elements may be interconnected by a base member or a plate that may be positioned within a lateral area or along a lateral edge within the forefoot region of the sole member. Likewise, a plurality of the retractable traction elements may be interconnected by a base member that may be positioned within a medial area or along a medial edge within the forefoot region of the sole member. The retractable traction elements positioned in the lateral area may operate independent from the retractable traction elements positioned in the medial area. Further, the retractable traction elements in the lateral area and in the medial area may define distinct and discrete inserts or elements that may be attached to or otherwise engaged with the sole member between the midsole or insole and the outsole.

The retractable traction elements may include a ground-contacting element and extension inducing element. The extension inducing element may be capable of operationally engaging the ground-contacting element, forcing it to selectively extend from a first position to a second position. A force may be applied to the extension inducing element during the normal course of a user's activity, such as walking, jogging, running, or the like. As explained in detail above, a user of an article of footwear may apply a force to the heel region, the midfoot region, and the forefoot region of the sole member of the article of footwear as the foot moves through the supination, pronation, and swing phases of a step.

Specifically, in some steps and during some movement activities, greater force may be applied to the sole member in the heel region and in areas along the medial edge and/or the lateral edges of the forefoot region of the sole member. A plate or insert including a plurality of secondary or retractable traction elements may be positioned along the medial edge area and/or along the lateral edge area of the sole so that the retractable traction elements may be selectively extended and refracted during the normal motion of a user's activity.

For example, the extension inducing element of the retractable traction elements may be capable of receiving a force from a user (e.g., as a result of a step down or foot plant) that may cause the sole member to engage with the ground or surface, such as during running, walking, pivoting, or the like. The force may be received by the extension inducing element and may cause the extension inducing member to flex. In one example, the extension inducing element may be a dome shape. When a force is applied to the dome shape, it flexes so that its crest extends toward the ground or surface in a spring-like motion. The material and shape of the extension inducing member may be such that the member deforms under an exerted force and "springs back" to its original shape when the force is relieved or removed.

Given the nature of a dome shape, a force applied anywhere along the surface of the dome may cause the dome to flex and have a spring-like effect. The intensity of the force (and thus the spring-like effect of the dome structure) varies based on the angle at which the force engages or contacts the dome. A force engaging the dome near the dome's crest may result in a more intense extension, whereas a force engaging the dome near its edge may result in a less forceful extension (or may be insufficient to cause the dome to flex).

In another example, the extension inducing element may be a leaf spring having an elliptical or otherwise raised top surface extending away from a flat or base surface, such as an insert, and having two side areas. In many examples, the side areas may be holes (or voids) and may allow the elliptical top surface to extend beyond the plane defined by the flat surface. The leaf spring may extend to any suitable position.

In both of the aforementioned examples, the surface of the extension inducing element or may be rounded or partially rounded (e.g., a three dimensional multi-sided polygon) that may be capable of distributing force more evenly throughout the traction element than a flat surface. Although the surface may be any suitable shape, at least some of the example extension inducing members used in structures according to the invention have a rounded or curved surface.

The extension inducing elements may be positioned in a retracted position when force is not being applied thereto and thus the retractable traction element may be suspended above the ground or surface. For example, the retractable traction elements may be positioned in a retracted position until a force causes them to selectively extend from a first, retracted position to a second, extended position, e.g., such as when users step on the sides of their foot when making a turn or cut, when a golfer's weight shifts over the course of a golf swing, etc.

The non-retractable traction elements may be static with respect to a force being applied to the sole structure or the secondary traction elements. The non-retractable traction elements may form at least a portion of the ground contacting surface of the sole member, and these non-retractable traction elements may engage the ground or surface each time the sole member engages the ground or surface.

In contrast, the retractable traction elements engage the ground only when a sufficient force is applied to the extension inducing element. These retractable traction elements may extend through openings in the sole structure from the first, retracted position to the second, extended position in response to the force. This configuration may permit the retractable traction elements to respond and provide fraction for targeted areas of the sole member and in response to specific movements executed by the user without weighing down the article of footwear, with larger heavier non-retractable traction elements and without causing unnecessary difficulties during the supination, pronation, and swing phases of the normal step cycle.

The ground-contacting element may be attached to the extension inducing element and may be operationally engaged or activated by the extension inducing element. The ground-contacting element may include any suitable material, including the same material as the extension inducing element. The ground-contacting element may be engaged with or operatively coupled to the extension inducing element by any suitable attachment mechanism and in any suitable position on the extension inducing element. For example, the ground-contacting element may be attached to the extension inducing element at or near the crest of the interior surface of the dome configuration and/or the leaf spring configuration.

The ground-contacting element may be any suitable shape and/or size. For example, a portion of the ground-contacting element may be conical or cylindrical. Any portion of the body and/or the tip portion of the ground-contacting element may be flattened, rounded, pointed, and/or tapered, depending on the functional needs of the user or wearer. In one example, the ground-contacting element may have a cylindrical shape through its body that may taper to a cone-shaped end portion or a rounded or flattened end surface. In another example, the ground-contacting element may have a plurality of flat sides and a tapered, flattened end portion (e.g., akin to the shape of a conventional baseball spike).

The extension inducing element and the ground-contacting element may function in unison to respond to a force and provide additional traction along the sole member. The retractable traction elements may be selectively engaged so that the ground-contacting element extends through the openings in the sole member and engages with the ground or surface, as described above. The ground-contacting element may automatically respond to the application of force to the extension inducing element, e.g., in response to a force in a pre-determined direction, such as when users make a turn and plants their foot on a surface and then subsequently pushes off on the lateral and/or medial side of their foot.

In general, another aspect of the invention relates to traction elements comprising: (a) a plurality of extension inducing elements capable of receiving and transmitting a force; (b) a plurality of ground-contacting elements capable of receiving the force from at least one of the plurality of extension inducing elements, each of the ground-contacting elements in operational engagement with at least one of the extension inducing elements; and (c) a plate interconnecting at least the plurality of extension inducing elements, the plate capable of being attached to an object; wherein at least one of the plurality of ground-contacting elements is capable of extending from a first position at a first distance from the plate to a second position at a second distance from the plate that is greater than the first distance in response to an application of force upon at least one of the extension inducing elements. At least one of the plurality of ground-contacting elements may be arranged so as to be capable of extending through at least one hole in a sole structure from a first position at a first distance from a plate of the sole structure to a second position at a second distance from the plate that is greater than the first distance. The ground-contacting elements may be capable of extending in response to the force. In general, another aspect of the invention relates to methods of providing traction and may comprise the steps of: (a) applying a force to a traction element, the traction element having an extension inducing element and a surface-contacting element, the extension inducing element operationally engaged with the surface-contacting element; (b) causing the surface-contacting element to selectively extend through an opening in an article of manufacture in response to an application of force to the extension inducing element, the surface-contacting element extending from a first retracted position to a second extended position; and (c) causing the surface-contacting element to engage a surface when the traction element is in the second extended position.

In yet another aspect of the invention, a method of providing traction for an article of manufacture may comprise the steps of: (a) applying force to a traction element, the traction element having an extension inducing element and a ground-contacting element, the extension inducing element operationally engaged with the ground-contacting element; (b) causing the ground-contacting element to selectively extend through an opening in a base member structure in response to the application of force to the traction element, the ground-contacting element extending from a first retracted position to a second extended position; and (c) causing the ground-contacting element to engage a surface when the traction element is in the second extended position.

Specific examples of the invention are described in more detail below. The reader should understand that these specific examples are set forth merely to illustrate examples of the invention, and they should not be construed as limiting the invention

B. Specific Examples of Articles with Retractable Traction Elements

The various figures in this application illustrate examples of articles with retractable traction elements according to this invention. When the same reference number appears in more than one drawing, that reference number is used consistently in this specification and the drawings to refer to the same or similar parts throughout.

Figure 2:
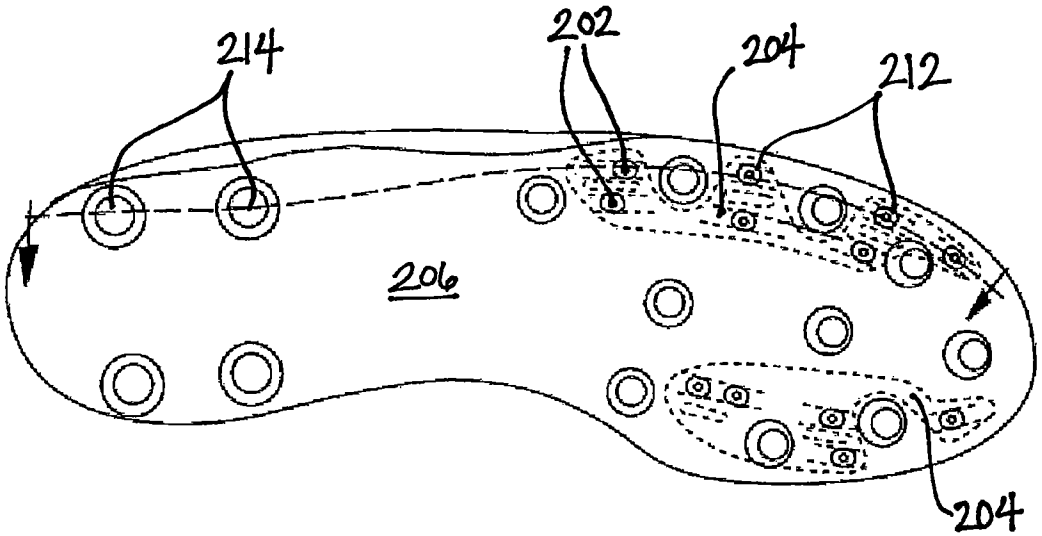
FIGS. 2, 2A, and 2B illustrate bottom and cross-sectional views of a plurality of retractable traction elements embodied in an article of footwear, according to aspects of the invention.
Figures 2A, 2B:
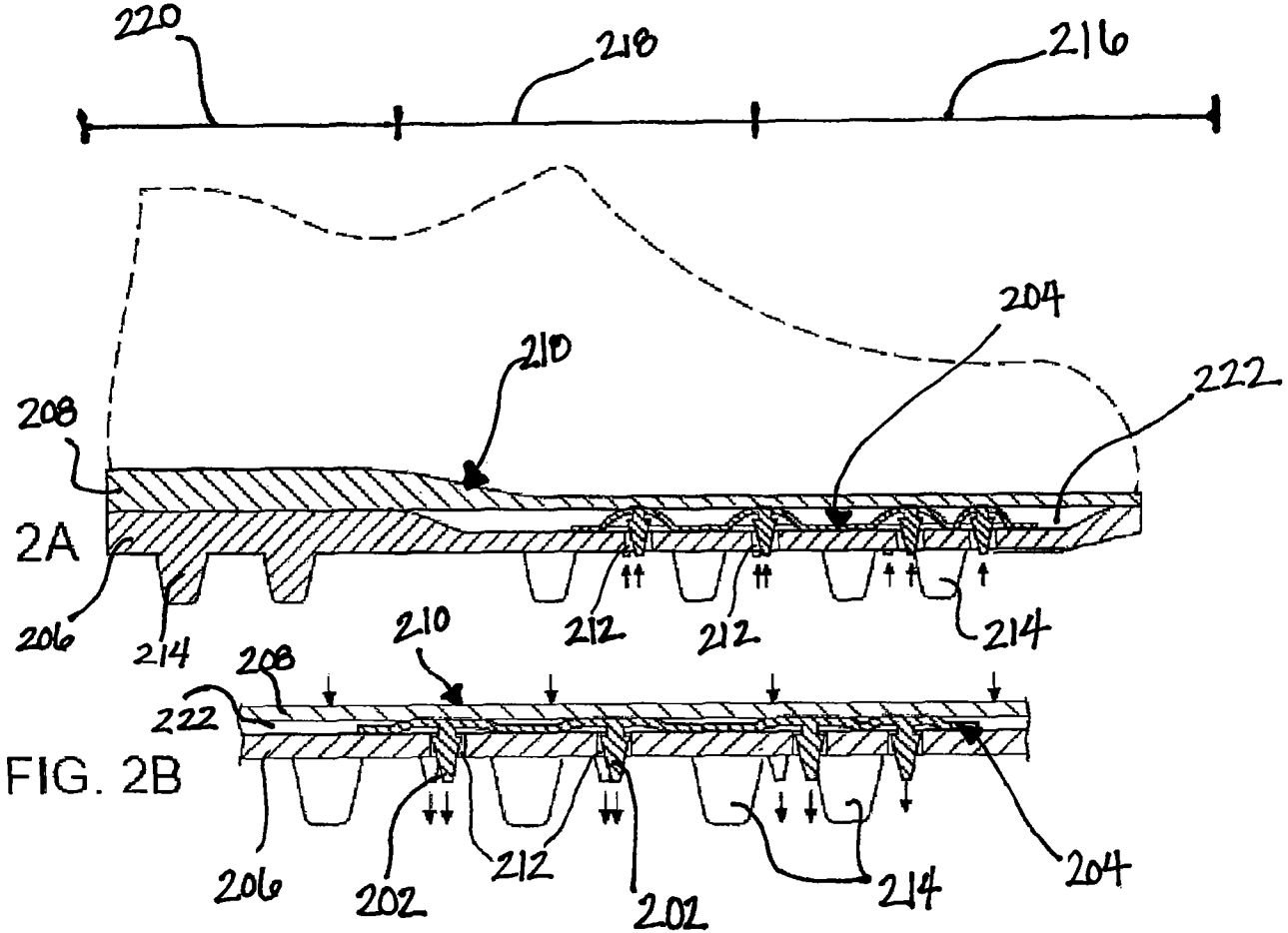

FIGS. 1A and 1B illustrate an article of footwear 100 having a plurality of retractable traction elements 102. The retractable fraction elements 102 may be attached to or extend through the outsole 104 and may form a surface-contacting feature of the article of footwear 100. As shown in FIG. 2, the retractable traction elements 202 may be interconnected by a base member or insert 204. FIGS. 2A and 2B illustrate the insert 204 positioned between the outsole 206 and the midsole 208 of the sole member 210. The outsole 206 may define a plurality of holes 212 through which the retractable fraction elements 202 may extend. In this example footwear structure, the retractable traction elements 202 may serve as secondary traction to the more permanent or non-retractable traction elements 214. The retractable traction elements 202 may be "activated" to extend through the holes 212 of the outsole 206 when sufficient force is applied to the midsole 208 and/or an insole (not shown), such as through the phases of a normal step cycle or when a user steps down or pushes off on the lateral or medial sides of the shoe. While the retractable traction elements 102 may be provided at any location or locations in the sole structure, in this illustrated example structure 100, the retractable traction elements are generally located along the medial and lateral edges in the forefoot region of the shoe 100.

Referring again to FIGS. 1A and 1B, the retractable traction elements 102 may be attached to some portion of the sole member 106 and/or any portion of the article of footwear 100. The retractable traction elements 102 may be attached in any suitable fashion including, but not limited to adhesives, molding, mechanical connecters, and the like. As shown in FIG. 2, the retractable traction elements 202 may be attached to the sole member 210 so that the insert 204 may be positioned between the midsole 208 and the outsole 206 and the retractable traction elements 202 may extend through the holes 212 in the outsole 206 to engage with the ground or other surface.

In this example footwear structure, a group of non-retractable traction elements 214 are attached to the outsole 206 and define a ground-contacting surface of the outsole 206. The non-retractable traction elements 214 remain static with respect to the sole structure 210 during the supination and pronation phases of the normal step cycle and may respond to varying angles and intensities of force. If desired, the non-retractable traction elements 214 may be detachable from the outsole 206 in any desired manner. The retractable or secondary traction elements 202 may be selectively engaged (e.g., when the user steps down on the footwear at a specific angle, such as when stopping, changing directions, making a cut or turn, etc.) while the non-retractable traction elements 214 may serve as the non-retractable source of traction for the wearer.

FIGS. 2, 2A, and 2B illustrate a bottom view and cross-sectional views, respectively, taken along a longitudinal plane defined by line 2-2 of FIG. 1. The longitudinal axis extends along line 2-2 between the toe in the forefoot region 216 and the heel in the heel region 220 of the article of footwear. Both the retractable traction elements 202 and the non-retractable traction elements 214 may extend away from the sole member 210 and toward the ground. The retractable traction elements 202 may extend through holes 212 in the outsole 206 and may be spaced apart so that one or more of the retractable traction elements 202 may be positioned in between one or more of the non-retractable traction elements 214.

A space 222 may be created between the outsole 206 and the midsole 208 in which the insert 204 may be positioned. The space 222 may extend along the portion of the sole member 210 that includes the insert 204. As illustrated in FIGS. 2, 2A, and 2B, the space 222 may extend at least partially through the forefoot region 216 and/or at least partially through the midfoot region 218. The heel region 220 may or may not have a space 222. In FIG. 2, the heel region 220 is illustrated without a space 222. Of course, the heel region 220 may also include one or more retractable fraction elements without departing from the invention.

A first retractable traction element and a second retractable traction element within a single sole structure may be capable of moving independently from one another. The first retractable traction element may be in an extended position while the second retractable traction element may be simultaneously in a retracted position (or vice versa). This situation may occur when a wearer is pivoting on his or her foot or is changing direction and thus causing sufficient force to be applied to extend the retractable fraction elements at some portions of the article of footwear, while insufficient force may be applied to other portions of the sole structure to cause other retractable traction elements to extend.

The first retractable traction element may contain a first set of characteristics and the second retractable traction element may contain a second set of characteristics that is different from the first set of characteristics. For example, the first retractable traction element may contain a first elasticity and flexibility and the second retractable traction element may contain a second elasticity and flexibility that is more rigid than the first elasticity and flexibility. The characteristics of the traction elements may include any features and/or materials. As another example, if desired, the retractable traction elements on the medial side of the article of footwear may differ from the traction elements on the lateral side of the article of footwear.

Figure 3A:
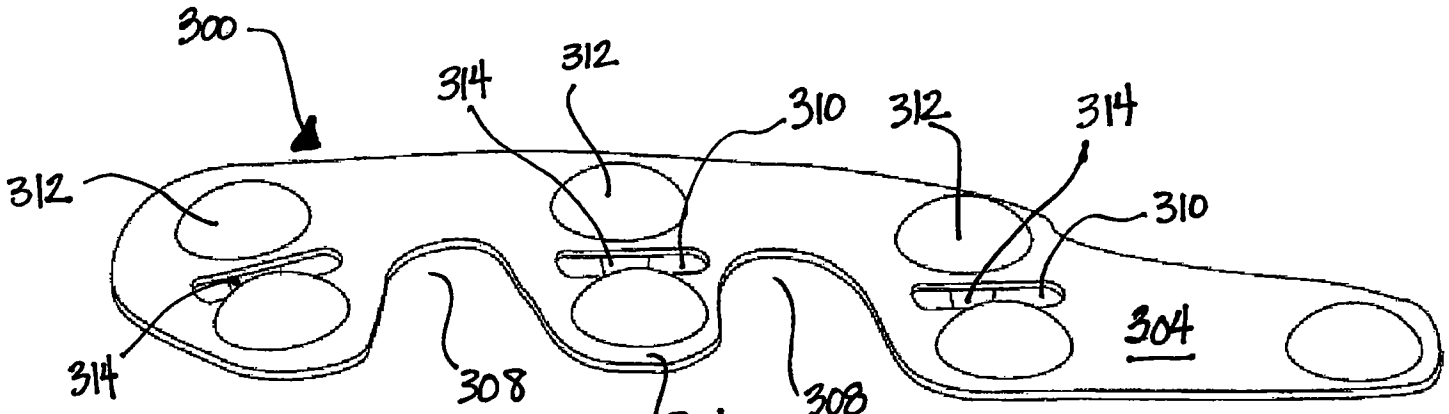
FIGS. 3A and 3B illustrate a top and bottom perspective view, respectively, of an insert having a plurality of retractable traction elements, in accordance with aspects of the invention.
Figure 3B:
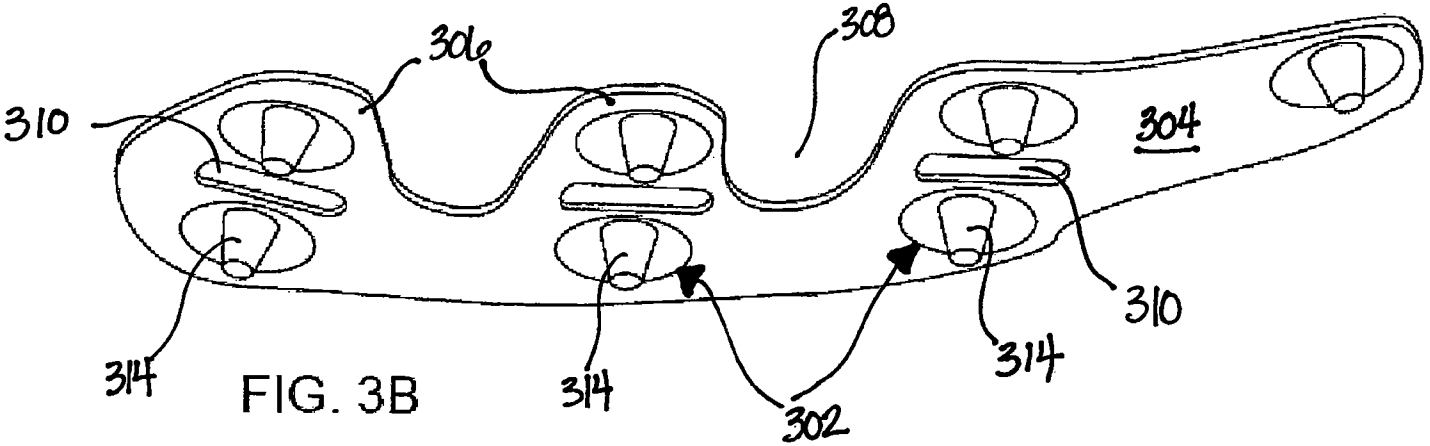

FIGS. 3A and 3B illustrate an example of an insert 300 or base having a plurality of retractable traction elements 302. The insert 300 may be shaped in any suitable shape. For example, the insert 300 may be generally oblong and may include a base member 304 having an elongated portion and a plurality of projections 306. The plurality of projections 306 may define one or more indentations 308 along the edge of the insert 300. The indentations 308 may be positioned around another element or elements in the sole structure, such as a non-retractable traction element, to which the insert 300 may be attached.

In at least some examples, the base member 304 of the insert 300 may also have a plurality of holes 310. The holes 310 may define a void that helps reduce the overall weight of the insert 300 and/or helps control the flexibility of the insert 300. For example, the insert 300 may be positioned between an outsole and a midsole of a member of an article of footwear. The insert 300 may be manufactured from a variety of suitable materials. The material may be one or more of a thermoplastic polyurethane elastomer (TPU), a nylon and TPU blend, rubber, plastics, or any other suitable material or combination of materials. The presence of the holes 310 or the voids results in an absence of material and an overall lighter weight of the insert 300 and may make the plate more flexible. The holes 310 may be positioned in any location on the insert 300. Any number of holes 310 may be included in the insert 300.

Figure 4A:
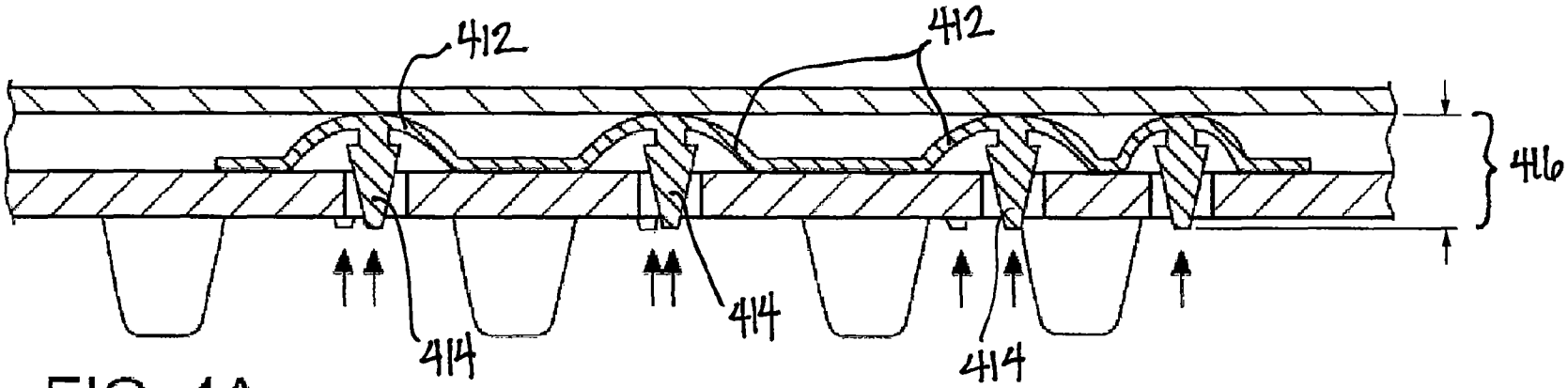
FIGS. 4A and 4B illustrate cross-sectional views of a portion of an outsole having a plurality of retractable traction elements, in accordance with another aspect of the invention.
Figure 4B:
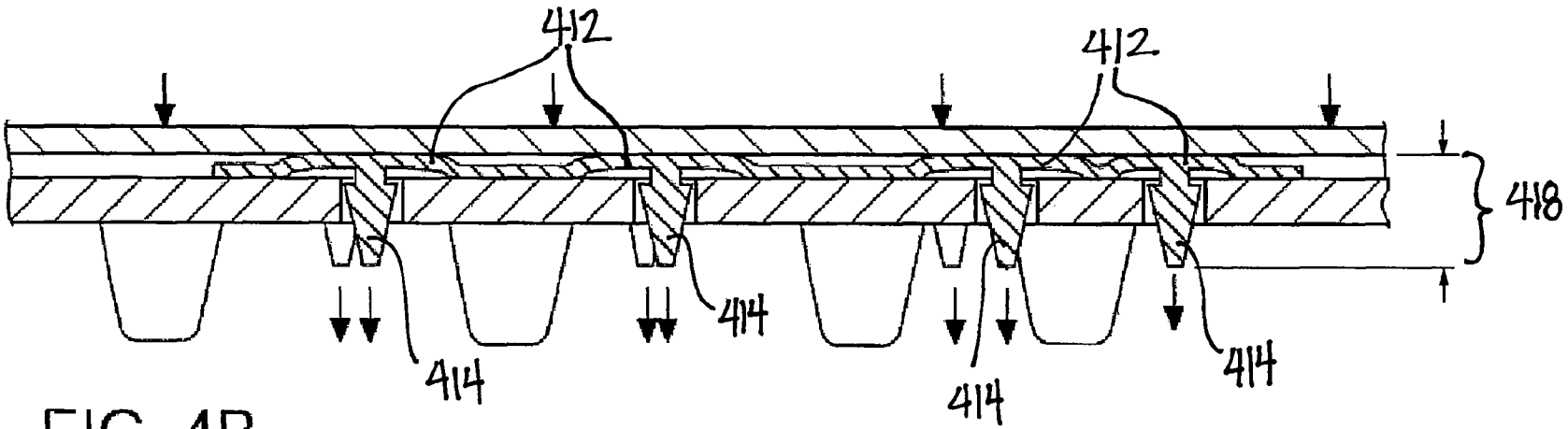

The insert 300 may include one or more traction elements 302, as illustrated in FIGS. 3A and 3B. One or more of the fraction elements 302 may include an extension inducing element 312 and a ground-contacting element 314. In some examples, the ground-contacting element 314 may be fixedly attached to and/or in operational engagement with the extension inducing element 312. For example, FIGS. 4A and 4B illustrate how the extension inducing elements 412 may be shaped as a dome having an exterior, convex surface and an interior, concave surface. The ground-contacting element 414 may be fixedly attached to or integrally formed at the crest of the interior surface. The dome may flex in response to a force and may cause the ground-contacting element 414 to extend from a first (retracted) position 416 to a second (extended) position 418.

Figure 5:
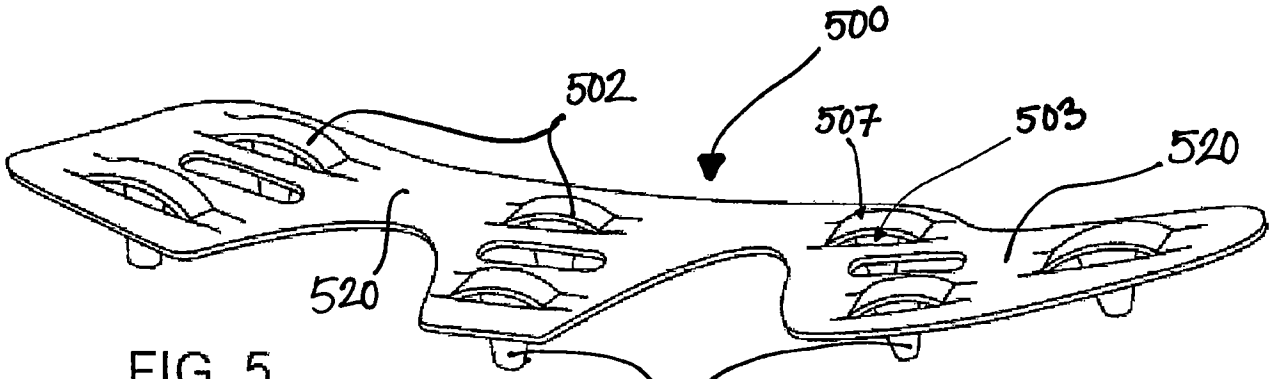
FIGS. 5, 5A, and 5B illustrate a top and cross sectional view of another embodiment of an insert having a plurality of retractable traction elements, according to aspects of the invention.

FIG. 5 illustrates another example insert 500 having a plurality of retractable traction elements that each includes an extension inducing element 502 and a ground-contacting element 504. In this example structure 500, the extension inducing elements 502 of the retractable traction elements are in the shape of a leaf spring. The extension inducing element 502 may have two opposing flat side walls 503 and a rounded top wall 507 defining an interior space 505. The two flat side walls 503 may define voids (i.e., the side walls are cut-out and do not have material) so that the top wall 507 or extension inducing element 502 may flex into the interior space 503 when adequate force is applied.

Figure 5A:
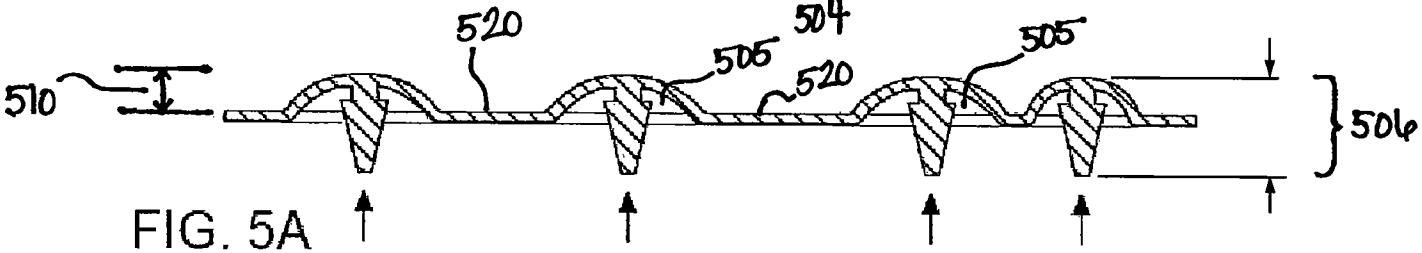
Figure 5B:
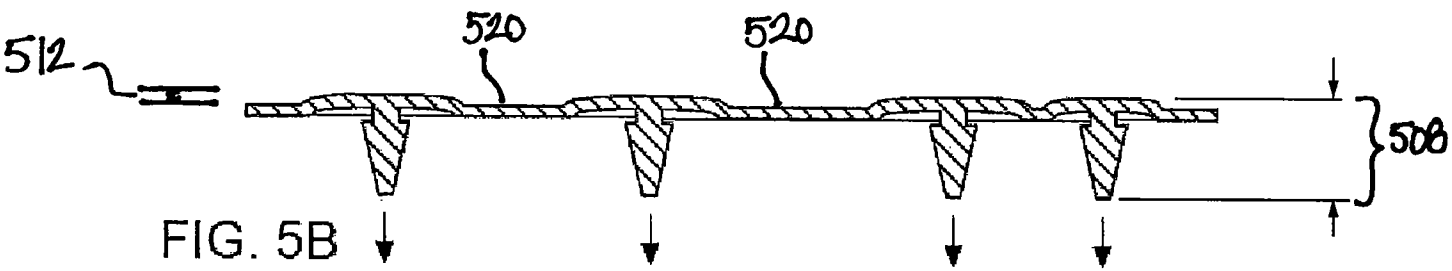

FIGS. 5A and 5B illustrate the leaf spring embodiment of the insert 500 in more detail. The ground-contacting elements 504 may extend from a first (retracted) position 506 to a second (extended) position 508. In some examples, as illustrated in FIGS. 5, 5A, and 5B, the extension inducing elements is curved upward above a base surface 520 of the insert 500. The upwardly curved top wall 507 may be flexed in response to sufficient force to extend from a first height 510 to a second height 512. In this case, the top wall 507 deforms and absorbs the force, which causes the ground-contacting elements to move to the extended position. The top wall 507 may flex in any suitable manner and may deform to any suitable size and shape.

The articles of footwear and the retractable traction elements illustrated in FIGS. 1-5 may contain any number of inserts. The examples shown in FIG. 2 contain two inserts. The first insert may extend along a lateral portion within the forefoot and/or midfoot regions of the sole member. A second, independent insert may extend along a medial portion within the forefoot region of the sole member. If desired, another insert may be positioned within the heel region, midfoot region, and/or any region of the sole member of the article of footwear.

FIGS. 1-5 illustrate examples of articles of footwear that may incorporate retractable traction elements. Many articles of footwear may benefit from the presence of retractable traction elements, such as athletic cleats, athletic footwear, water shoes, hiking boots, rock climbing shoes, work boots, protective footwear, military footwear, custom orthotic footwear, or the like. Any style or type of articles of footwear may incorporate retractable fraction elements.

Figure 6:
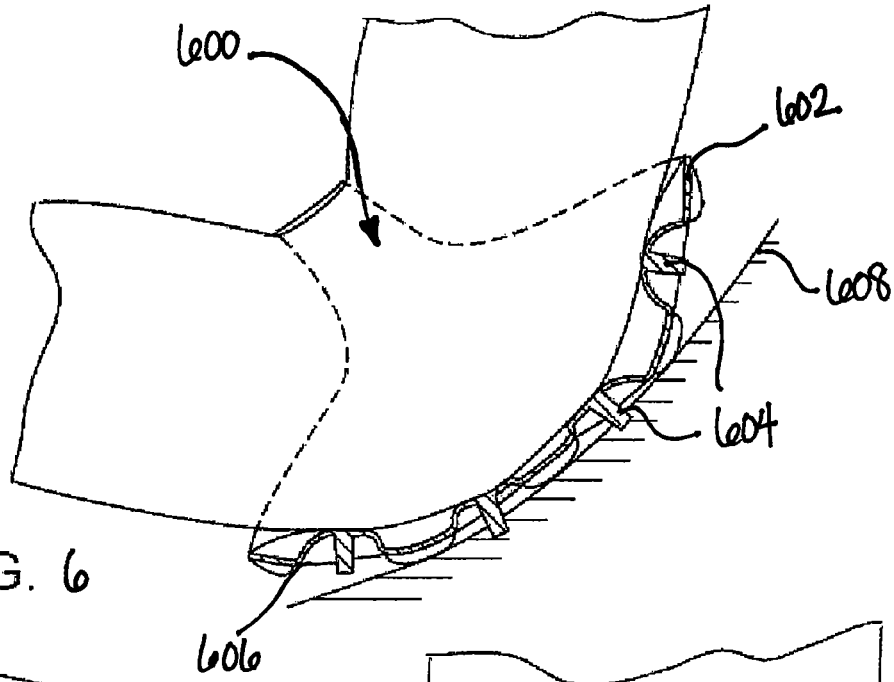
FIG. 6 illustrates an elbow pad containing a plurality of traction elements in an alternative embodiment according to aspects of the invention.

The retractable traction elements may also be used in articles of apparel, athletic equipment, and other protective gear, such as knee pads and elbow pads. FIG. 6 illustrates an elbow pad 600 including an insert 602 having a plurality of retractable traction elements 604. The retractable traction elements 604 may extend through an exterior surface 606 of the elbow pad 600 in response to sufficient force, such as when the elbow engages with the ground or other surface 608 during a fall.

Figure 7:
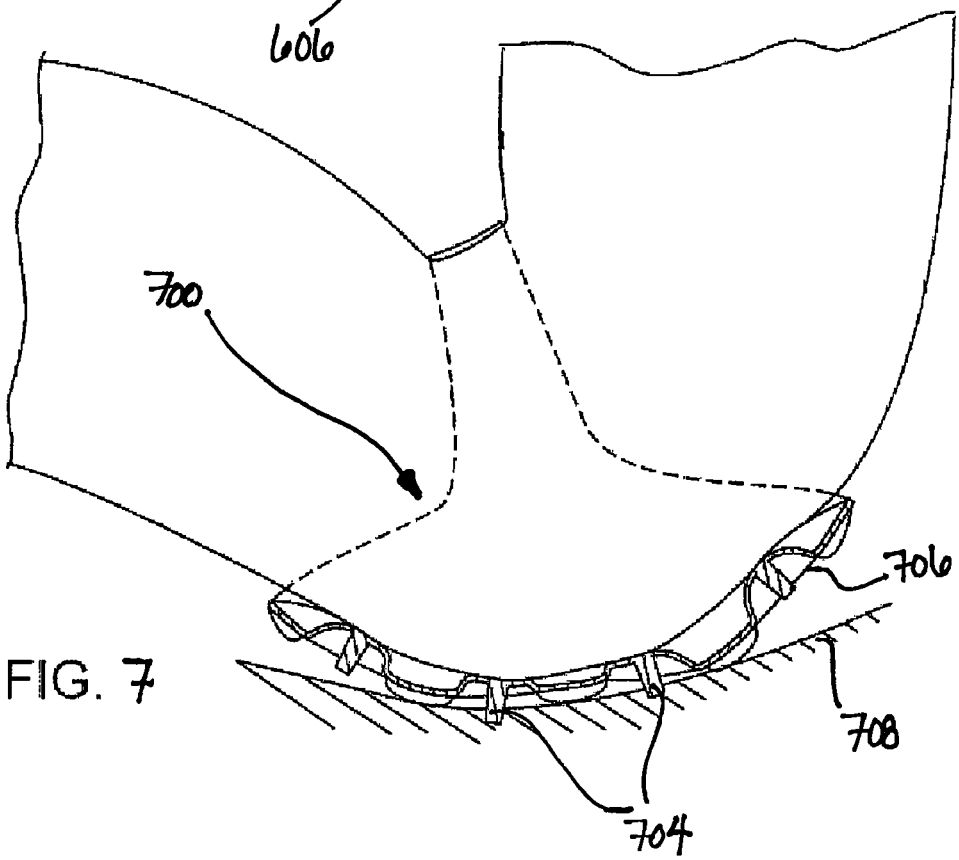
FIG. 7 illustrates a knee pad containing a plurality of traction elements in an alternative embodiment, in accordance with aspects of the invention.

FIG. 7 illustrates a knee pad 700 having an insert with a plurality of retractable traction elements 704 included therein in a similar fashion to the elbow pad 600 illustrated in FIG. 6. The retractable fraction elements 704 may extend beyond an exterior surface 706 defined by the knee pad 700 when the user's knee engages with a surface 708, such as when the user falls or kneels on the ground, when the user climbs a hill or mountain, etc.

As illustrated in FIGS. 8 and 9, retractable traction elements may be provided in area rugs, door mats, or other similar surfaces. These retractable traction elements may engage with an underlying surface, such as the ground or carpeting, when sufficient force is applied. The retractable traction elements 902 in FIG. 9 illustrate a user's foot applying sufficient force to the top surface of the mat 900 to cause the traction elements at the area of the applied force to extend beyond the bottom surface of the mat 900, engage with the ground or other surface 906, and provide selectively available traction and stability.

Mats having retractable traction elements of this type may be easier to remove from the underlying surface (such as the ground or carpet) as compared to similar mats with permanently extended and fixed traction elements.

A user may position a mat of the type illustrated in FIGS. 8 and 9 on any surface, such as a tile or smooth floor in a gymnasium, bathroom, or kitchen. The bottom surface of the mat may include a material that may be easily slid along the surface. The retractable traction elements may be made of a suitable material to provide a similar function in the bathroom and/or kitchen mat embodiment and in the gymnastics and/or acrobatic mat to selectively provide traction to the ground-contacting surface of the mat.

This same configuration may be applied to any surface that may be prone to slide against another surface. For example, cutting boards, oven mitts, hot pads, yoga and/or pilates mats, child changing pads, and any other article of manufacture that may engage with a surface. Many of these items may need to be moved or slid along a surface and would benefit from a selectively retractable traction feature, such as the retractable traction elements described above.

C. Conclusion

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

The invention claimed is:

1. An article of footwear, comprising:

an upper;

a sole member attached to the upper, the sole member having a plurality of openings in a bottom surface thereof; and a traction element insert contained in the sole member, wherein the insert includes a plate member having a plurality of deformable and upwardly-curved walls formed therein, each of the walls having an upper surface and a lower surface, the insert further includes a plurality of extendable ground-contacting traction elements, each of the ground-contacting traction elements attached to a different one of the lower surfaces at or near a crest of a concave region formed by the different one of the lower surfaces, and the sole member and plate member are configured such that downward force on the upper surfaces from a foot of a wearer of the article at least partially flattens the deformable walls to reduce concavity of the concave regions and extend the ground-contacting traction elements through the plurality of openings.

2. The article of footwear of claim 1, wherein, for each of the deformable walls, the deformable wall is in a shape of a leaf spring, the deformable wall is surrounded by adjacent flat side walls, edges of the adjacent flat side walls and edges of the deformable wall form voids on opposing sides of the deformable wall, and the edges of the adjacent flat side walls form sides of an opening in the insert through which the ground-contacting traction element corresponding to the deformable wall extends.

3. The article of footwear of claim 1, wherein the plurality of ground-contacting traction elements includes a first ground-contacting traction element and a second ground-contacting traction element, the first ground-contacting traction element capable of retracting and extending independently of the second ground-contacting fraction element.

4. The article of footwear of claim 1, further comprising a plurality of non-retractable traction elements attached to the sole member.

5. The article of footwear of claim 4, wherein the plurality of non-retractable traction elements are permanently mounted to the sole member.

6. The article of footwear of claim 1, wherein each of the deformable walls and the ground-contacting traction element attached thereto forms a retractable traction element, wherein a first of the retractable traction elements has a first set of characteristics and a second of the retractable traction elements has a second set of characteristics that are different from the first set of characteristics.

7. The article of footwear of claim 1, wherein the plate member defines at least one hole.

8. The article of footwear of claim 1, wherein the sole member comprises a midsole and an outsole, the plate member being positioned between the midsole and the outsole, and the openings are defined in the outsole.

9. The article of footwear of claim 1, wherein a first portion of the plurality ground-contacting fraction elements are positioned in the forefoot region of the article of footwear.

10. The article of footwear of claim 1, wherein each of the deformable walls and the ground-contacting traction element attached thereto forms a wall/traction element pair, a first portion of the wall/traction element pairs includes a medial group and a second portion of the wall/traction element pairs includes a lateral group, the medial group capable of operating independently of the lateral group.

11. The article of footwear of claim 1, wherein each of the ground-contacting traction elements include a tapered portion.

12. The article of footwear of claim 1, wherein a first portion of the ground-contacting traction elements is positioned to extend along a medial edge of a wearer's foot.

13. The article of footwear of claim 1, wherein the plurality of ground-contacting traction elements are positioned to extend longitudinally along a lateral edge of a wearer's foot.

14. The article of footwear of claim 1, wherein the insert is formed from thermoplastic polyurethane.

15. The article of footwear of claim 1, wherein the insert is formed from a blend of thermoplastic polyurethane and nylon.

16. The article of footwear of claim 1, wherein the plurality of deformable walls includes at least three deformable walls and the plurality of ground-contacting traction elements includes at least three ground-contacting traction elements.

17. An article of footwear, comprising:

an upper;

a sole member attached to the upper, the sole member having a midsole, an outsole and a plurality of openings defined in a bottom surface of the outsole; and a traction element insert contained in the sole member between the midsole and outsole, wherein the insert includes a plate member having a plurality of deformable walls formed therein, wherein each of the deformable walls is upwardly curved so as to have an upper surface and a lower surface, and the insert further includes a plurality of extendable ground-contacting traction elements, wherein each of the ground-contacting traction elements corresponds to a different one of the deformable walls, is attached to the lower surface of the corresponding deformable wall at or near a crest of a concave region formed by that lower surface, and is movable to an extended position in response to force at least partially flattening the deformable wall to reduce concavity of the concave region.

18. The article of footwear of claim 17, wherein for each of the deformable walls, the deformable wall is in a shape of a leaf spring, the deformable wall is surrounded by adjacent flat side walls, edges of the adjacent flat side walls and edges of the deformable wall form voids on opposing sides of the deformable wall, and the edges of the adjacent flat side walls form sides of an opening in the insert through which the ground-contacting traction element corresponding to the deformable wall extends.

19. The article of footwear of claim 17, wherein the plurality of ground-contacting traction elements includes a first ground-contacting traction element and a second ground-contacting traction element, the first ground-contacting traction element capable of retracting and extending independently of the second ground-contacting fraction element.

20. The article of footwear of claim 17, wherein the insert is formed from thermoplastic polyurethane.

21. The article of footwear of claim 17, wherein the insert is formed from a blend of thermoplastic polyurethane and nylon.

22. The article of footwear of claim 17, wherein the plurality of deformable walls includes at least three walls and the plurality of ground-contacting traction elements includes at least three ground-contacting traction elements.

23. The article of footwear of claim 17, further comprising a plurality of non-retractable traction elements attached to the sole member.

* * * * *